United States Patent [19]
Suovaniemi et al.
[11] 4,022,375
[45] May 10, 1977

[54] CENTRIFUGE

[75] Inventors: Osmo Antero Suovaniemi; Jukka Topias Tervamäki, both of Helsinki, Finland

[73] Assignee: Osmo Antero Suovaniemi, Helsinki, Finland

[22] Filed: Feb. 4, 1976

[21] Appl. No.: 655,053

[30] Foreign Application Priority Data

Feb. 14, 1975 Finland ..... 750424

[52] U.S. Cl. ..... 233/1 R; 233/24; 233/26

[51] Int. Cl.² ..... B04B 7/02

[58] Field of Search ..... 233/1 R, 1 B, 1 C, 11, 233/27, 23 R, 24, 26; 210/380 R, 380 L; 127/19

[56] References Cited

UNITED STATES PATENTS

| | | | |
|---|---|---|---|
| 2,827,229 | 3/1958 | Blum | 233/23 R |
| 3,148,146 | 9/1964 | Asnes et al. | 233/1 A |
| 3,240,425 | 3/1966 | Ray et al. | 233/1 R |
| 3,246,688 | 4/1966 | Colburn | 233/11 |
| 3,747,841 | 7/1973 | Ross | 233/1 B |
| 3,804,324 | 4/1974 | Sinn | 233/24 |

*Primary Examiner*—George H. Krizmanich
*Attorney, Agent, or Firm*—Hopgood, Calimafde, Kalil, Blaustein & Lieberman

[57] ABSTRACT

A laboratory centrifuge includes a housing and a support plate elastically mounted at the bottom of the housing. A rotor driven by an electric motor is mounted on the support plate together with a hood which surrounds the rotor. The motor, rotor and hood are rigidly connected for movement as a unit relative to the housing.

1 Claim, 1 Drawing Figure

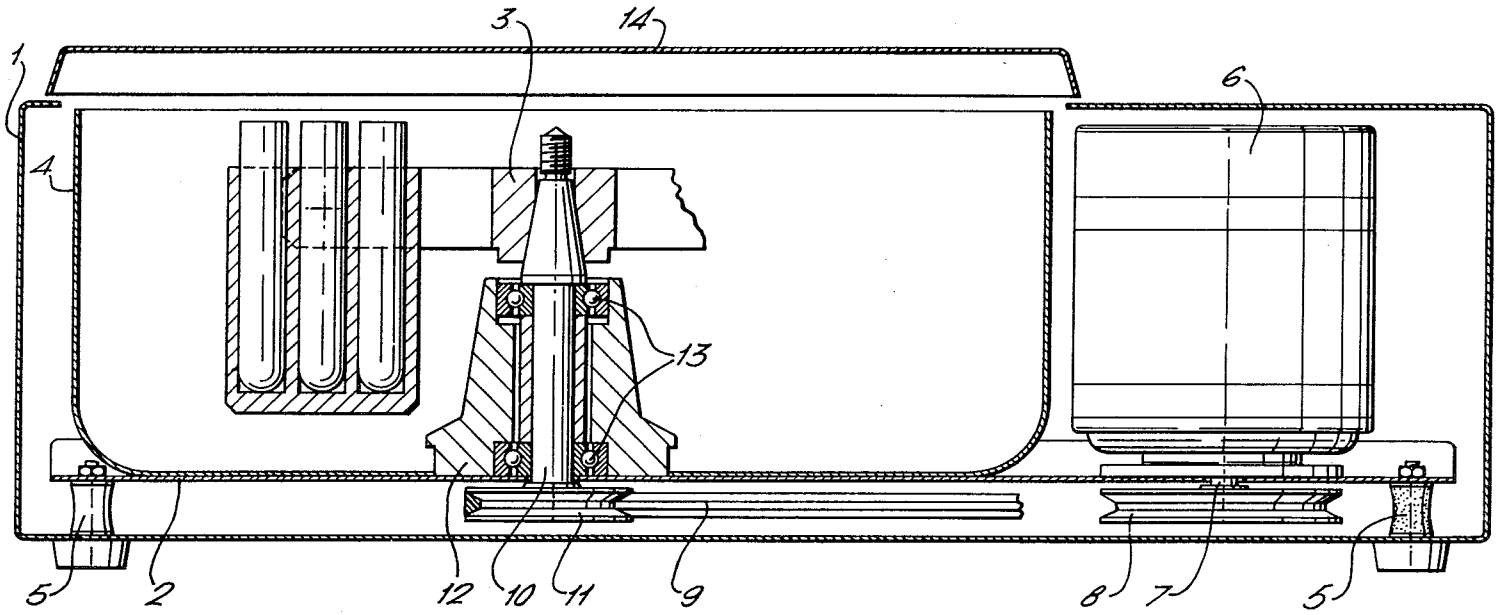
1
14
4
3
6
13
5
7
8
9
11
10
12
2
5

CENTRIFUGE

BACKGROUND OF THE INVENTION

The subject of the present invention is a laboratory centrifuge that comprises a protective housing provided with a cover, a rotor and an electric motor operating the rotor, and in which the of rotation of the shaft of the electric motor transferred the rotor shaft by a belt, V-belt, cog belt, chain, cogwheels or by any other transmission arrangement suitable for the purpose.

In the centrifuges presently on the market, the rotor is mounted on the extension of the output shaft of the electric motor.

These centrifuges involve several drawbacks. Since the motor is placed underneath the rotor, the construction of the centrifuge is tall, and it is difficult to place test tubes into a centrifuge on the work table or to remove tubes from same. It is also difficult to move a high round, partly round or cubic device in the laboratory.

In order to reach high speeds (4,000 to 12,000 rpm), in present centrifuges, brush motors are often used. The brushes increase the servicing requirement, and the high motor speeds increase the wear and noise.

SUMMARY OF THE INVENTION

In the centrifuge of the present invention, attempts have been made to eliminate the drawbacks that have appeared in the centrifuges on the market, and the centrifuge in accordance with the invention is mainly characterized in that the electric motor and the rotor, which is mounted inside a protecting hood, are firmly fixed to each other and to the hood. This assembly is mounted preferably flexibly, above the bottom of the protective housing, at a distance from said bottom.

Since the motor of the centrifuge is placed at the side of the rotor, the profile of such a centrifuge can be low. Hereby the working conditions are improved considerably and it is possible to work at the level on which, for example, pipettings, shakings, incubations, and measurements are performed. It is easy to move a low apparatus.

If required, the outer appearance of the centrifuge can be designed as uniform with the rest of the laboratory equipment without, nevertheless, increasing the size of the apparatus. Moreover, by means of constructional embodiments of similar appearance, it is possible to rationalize the series production of laboratory equipment. A possibility of such rationalization of course reduces the production costs of equipment.

To the centrifuge construction of the invention, it is possible to apply any known technique regarding the control, indication, safety, etc. equipment and constructions of the centrifuge.

BRIEF DESCRIPTION OF THE DRAWINGS

The invention is disclosed more fully in the following description and in the attached drawing, in which a centrifuge constructed in accordance with the invention is shown in section as viewed from the side.

DESCRIPTION OF THE PREFERRED EMBODIMENT

In a centrifuge constructed in accordance with the drawing inside the housing 1 the hood 4 of the rotor 3 is mounted stationarily on the housing 1 or on a support 2. The support 2 is flexibly mounted on the bottom of the housing 1 by means of elastic spacers 5. The motor 6 is mounted on the support plate 2. A V-belt pulley 8 is mounted on the shaft 7 of the motor 6. From the pulley 8 of the motor, the rotary movement is transmitted by a V-belt 9 to the V-belt pulley 11 at the end of the rotor 3 shaft 10. The rotor shaft 10 is mounted in the bearings 13 in the bearing box 12. The bearing box 12 is fixed either at the protecting hood 4 or at the support plate 2. The housing 1 is provided with a cover 14. As the construction of the centrifuge involves a transmission, by changing the transmission ratio even a relatively low-speed electric motor can provide high rotor speeds. A highly suitable power-source is an external-rotor shortcircuit motor. Since this motor includes no wearing brushes and has a relatively low speed of rotation (about 2,800 rpm), the motor produces no problems of maintenance or noise. Since the construction of the motor mentioned above and the construction of the centrifuge proper together produce a high moment of inertia for the rotary components, it is possible, for controlling the speed, to use a method in which the energy is, by means of semiconductor switches, passed to the motor as impulses that always contain full half-waves of the voltage from the network. Since the switching always takes place at the zero point of the alternating voltage, the method causes a minimum of disturbances to the voltage in the network.

It will occur to those skilled in the art that various modifications and variations within the scope and spirit of the invention are possible. Accordingly, the invention would not be deemed limited except as set forth in the appended claims.

We claim:

1. A laboratory centrifuge comprising a housing having an interior bottom surface, a cover hinged to said housing, a support plate having an upper and a lower surface, a plurality of elastic elements attached between said lower surface of said support plate and said interior bottom surface of said housing to elastically support said plate, an electric motor mounted on said upper surface of said support plate, a bearing box and bearings mounted on said upper surface of said support plate, a shaft held by said bearings, a rotor mounted on said shaft, means for driving said rotor from said electric motor, and a protective hood mounted on said upper surface of said support plate and at least partially surrounding said rotor, whereby said motor, rotor and hood are rigidly connected to said upper surface of said support plate for movement therewith as a unit relative to said housing.

* * * * *

UNITED STATES PATENT OFFICE

CERTIFICATE OF CORRECTION

Patent No. 4,022,375 Dated May 10, 1977

Inventor(s) OSMO ANTERO SUOVANIEMI & JUKKA TOPIAS TERVAMAKI

It is certified that error appears in the above-identified patent and that said Letters Patent are hereby corrected as shown below:

In the Claims:

Claim 1, line 49, before "plate", insert -- support --.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*